United States Patent [19]

Pretini

[11] 4,063,519

[45] Dec. 20, 1977

[54] ANTI-ROBBERY AND ANTI-HOSTAGE EQUIPMENT PROVIDED WITH A ONE-WAY ROTATING DOOR FOR BANKS AND THE LIKE

[76] Inventor: Gisberto Pretini, Via della Stazione, 3, S. Frediano A Settimo, Pisa, Italy, I-56026

[21] Appl. No.: 624,844

[22] Filed: Oct. 22, 1975

[30] Foreign Application Priority Data

Oct. 25, 1974 Italy ..... 9605/74

[51] Int. Cl.[2] ..... E05G 5/02

[52] U.S. Cl. ..... 109/8; 49/42

[58] Field of Search ..... 49/41, 42, 46; 109/3–8

[56] References Cited

U.S. PATENT DOCUMENTS

| | | | |
|---|---|---|---|
| 175,845 | 4/1876 | Washburn | 49/41 |
| 183,410 | 10/1876 | Menan | 49/46 |
| 1,558,058 | 10/1925 | Spottswood | 109/8 |
| 1,889,853 | 12/1932 | English | 49/42 X |
| 1,965,030 | 7/1934 | Clark | 109/8 |
| 3,045,615 | 7/1962 | Atchison | 109/3 |
| 3,285,209 | 11/1966 | Pace | 109/8 |
| 3,658,277 | 4/1972 | Anderson | 109/8 X |
| 3,924,546 | 12/1975 | Pretini | 109/3 |

FOREIGN PATENT DOCUMENTS

| | | | |
|---|---|---|---|
| 24,633 of | 1906 | United Kingdom | 49/46 |
| 219,416 | 7/1924 | United Kingdom | 49/46 |

*Primary Examiner*—Paul R. Gilliam
*Assistant Examiner*—David H. Corbin
*Attorney, Agent, or Firm*—McGlew and Tuttle

[57] ABSTRACT

The premises to be protected have at least one laterally confined passage communicating therewith, such as an entrance passage, an exit passage, or both. Each passage has mounted therein at least one rotating door, of the type including a vertically oriented rotatable post and a plurality of angularly spaced elements secured to and extending radially from the post, the door being freely rotatable in a single direction to permit one person at a time to pass along the passage in the single direction. Approximately half the circumferential extent of each door is enclosed by a semi-cylindrical barrier, and a treadle or other type of depressible floor section, responsive to the weight of a person entering into the door and attempting to rotate the door in the direction opposite to such single direction, operates a locking means device preventing movement of the door in either direction so that such a person is trapped in the door or between two doors located serially along the passage. The treadle or the like may be biased to a position flush with the floor by a positive air pressure so that, if the air pressure line is severed, the treadle will automatically drop and lock the door against rotation. Safety enclosures may be associated with the rotatable doors to allow a hostage to move safely out of any line of fire along the passage. The passage may be designed with portions extending at angles to each other, or even in reverse direction, so that there is no clear line of fire along the passage. The angularly spaced elements may be formed with bulges, as may also the post, assuring that only one person can enter the door between adjacent angularly spaced elements at a time.

10 Claims, 20 Drawing Figures

Fig.4
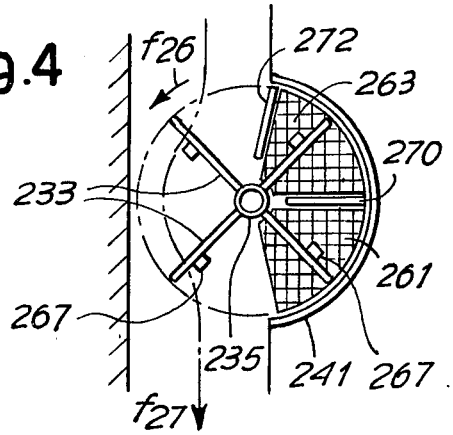
Fig.5
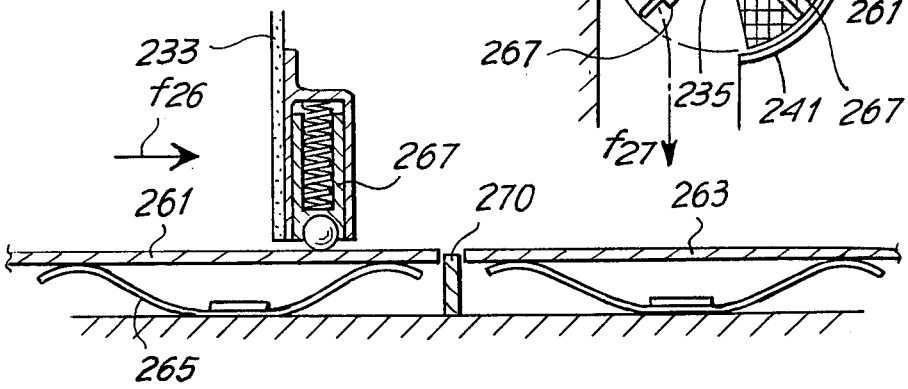
Fig.6
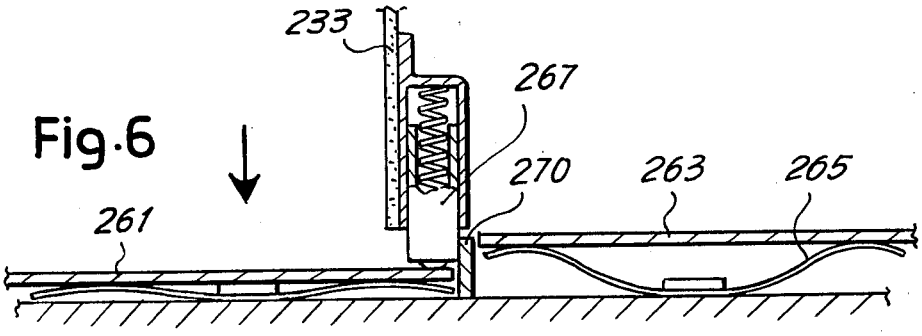
Fig.7
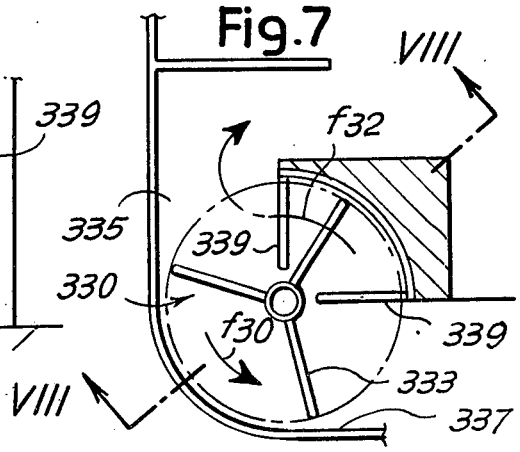
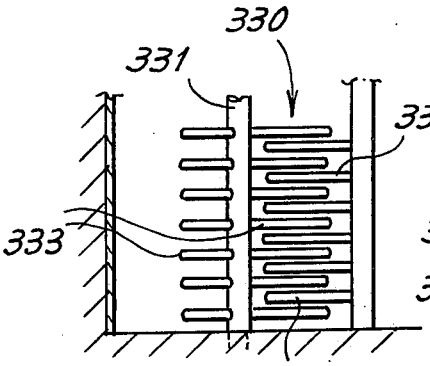
Fig.8

ANTI-ROBBERY AND ANTI-HOSTAGE EQUIPMENT PROVIDED WITH A ONE-WAY ROTATING DOOR FOR BANKS AND THE LIKE

SUMMARY OF THE INVENTION

The invention is directed to an anti-robbery and anti-hostage protection equipment for the premises of banks and the like, and includes, in combination with an access or entry passage and an exit passage, at least one rotating door which is freely rotatable in only a single direction and which door is divided, by radial arms or panels, into sectors designed to allow the transit of only one person at a time in the single direction. The door is further provided with means operable to prevent transit therethrough in a direction opposite to the desired direction.

This means may include at least a foot-board which yields resiliently responsive to the load of a person attempting to transit through the door in the forbidden direction, and this means effects locking of the rotating door. The foot-board may have a locking member, such as a plug or the like, which interferes with a member integral with the rotating door when the foot-board is lowered responsive to the weight of a person thereon. Alternatively, the rotating door may be provided with shoes or the like resiliently biased downwardly and sliding along a subfloor or other surface and on the foot-board or boards. Abutting means, such as a fixed radial segment, may be arranged downstream of the foot-board, with respect to the permitted rotational direction of the door, and against which a shoe, lowered responsive to the depression of the foot-board, engages.

The rotating door is provided with a plurality of angularly spaced radial walls, panels or arms extending from a central vertical core or post which is aligned along the vertical axis of rotation of the door. Both the post and the radial walls or panels of the door may be formed with swells or bulges protecting into the spaces, in the form of cylindrical sectors, defined by the radial walls, at an intermediate level with respect to a person's height so as to allow occupation of these spaces by only a single person who nevertheless has sufficient space to move his legs and arms to rotate the door. The rotating door is provided with bullet-proof radial walls, such as bullet-proof glass.

Advantageously, in the area of the rotating door, there are provided fixed arcuate walls and/or labyrinth paths designed to defilade the surrounding premises with respect to firing of a weapon by a person locked up in the equipment. Each rotatable door, designed for the transit of only one person at a time, advantageously is surrounded at least partly by several fixed panels located in a manner such as to define the periphery of the rotating door.

There also may be provided, in combination with the rotating door and with the fixed panels, a caveau or recess, with access through the panels by means of a door, and which may be used by a hostage who is forced to go toward the sector of the door having the locking foot-board. This access door may be closed from within the recess.

The rotating door is also combined with a remote control locking device, for example, one operated by watch personnel, to lock the door in such a position that an unauthorized person cannot exit from the sector of the door he occupies, and thus cannot harm third parties with weapons in his position. A person trapped within such a sector may thus be shielded from weapons of people outside the sector.

The equipment of the mentioned type advantageously involves at least two unidirectional rotational doors along the same exit path, arranged in series for defense and dissuasion and also in the case of several hostages in the hands of abductors. In order to facilitate the flow of persons along the path or passage, two or more pairs of rotating doors may be provided for a parallel operation.

The equipment of the present invention is suitable for being mounted in accordance with my Italian Pat. No. 938,606, my French Pat. No. 2,156,060, or my Swiss Pat. No. 552,855 in which, for access to the protected premises and the like, there is provided a fixed elongated path either within or outside the premises, with bullet-proof transparent crystal walls, at least when the path is provided within the premises. The external corridor walls, which simply serve to direct the traffic to the street, may be made of other material. In particular, the path may have the same outer paving or, apart therefrom, may be defined by means of a partition formed with a provisional barrier or the like. The presence of the crystal walls allows visibility of the persons passing along the passage, both directly by the personnel of the bank and from the exterior, and by optical means.

At least a motion picture camera, especially a television camera or an equivalent suitable means, may be arranged to control the fixed path during public admittance. The control apparatus may record the images on a suitable memory, such as a tape or the like, which advantageously can be reused periodically when the recording is no longer useable after a short time. Such a memory is useful to identify robbers, in the case of a criminal action. A magnetic recording tape is also useful for television observation. The camera may also be adapted to transmit visual information to a control center.

The equipment of the invention may also include closure means, such as a sliding door or the like, automatically operable by the security staff and in a manner completely independent of the power system. For example, the door may be operable by a pneumatic system. Closure means of this type are arranged at least at the ends of the fixed path to effect locking of robbers within the path, and to prevent access from the path into public places as well as to prevent exit from the path while the security staff is protected within a staff room or the like. The equipment may also be provided with means for rapid introduction of hypnotic gases or the like within the area of the fixed path.

The invention equipment may include two fixed paths, one an entrance path and the other an exit path, and each path may be provided with automatic closure and opening means, to prevent traffic in a direction opposite to the predetermined direction.

All the control and drive motors and the like may be provided in such a manner as to prevent neutralization by robbers or by members of the staff who might be induced to such neutralization through violence or because of a particular psychological effect arising from the circumstances. Such controls are especially set up by lowering the pressure in a room which is usually under a pressure higher than atmospheric.

An object of the invention is to provide an improved anti-robbery and anti-hostage equipment for the premises of banks and the like.

Another object of the invention is to provide such equipment by means of which a robber or the like can be effectively restrained against leaving the premises.

A further object of the invention is to provide such an equipment including at least one rotating door in each passage communicating with the premises, the door being freely rotatable in a single predetermined direction.

For an understanding of the principles of the invention, reference is made to the following description of typical embodiments thereof as illustrated in the accompanying drawings.

BRIEF DESCRIPTION OF THE DRAWINGS

In the Drawings:

FIG. 4 is a schematic horizontal section illustrating a modified embodiment of the invention.

FIGS. 5 and 6 are vertical sectional views illustrating a locking device, with FIG. 5 illustrating the device in normal position and FIG. 6 illustrating the device in the locking position;

FIG. 7 is a horizontal sectional view of another embodiment of the rotating door;

FIG. 8 is a sectional view taken along the line VIII—VIII of FIG. 7;

DESCRIPTION OF THE PREFERRED EMBODIMENTS

Figure 1:
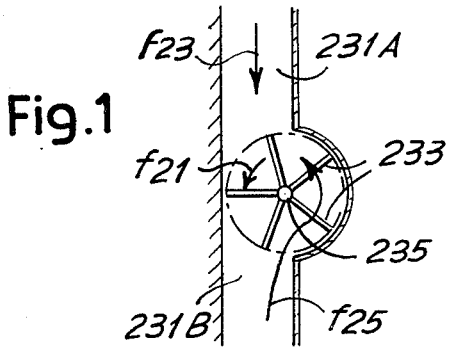
FIG. 1 is a diagrammatic plan of one embodiment of the invention.

Before description of the various arrangements of the equipment embodying the invention, the construction of typical unidirectional rotating doors of the invention will be described. Referring to FIG. 1, for the purpose of providing unidirectional transit along the corridor path 213A, 213B, there is arranged a door rotating like a rotor around a vertical axis, for example, in the direction of the arrow $f_{21}$, if the direction of transit in corridor 231A, 231B is as indicated by the arrow $f_{23}$. The door comprises a plurality of angularly spaced radial walls 233 extending radially outwardly from the vertical axis of rotation 235 of the door. Between angularly adjacent radial walls 233, there is a sufficient space so that the person may pass in the direction of the arrow $f_{23}$ through the interference area between the corridors 231A and 231B and the rotor 235.

Figure 2:
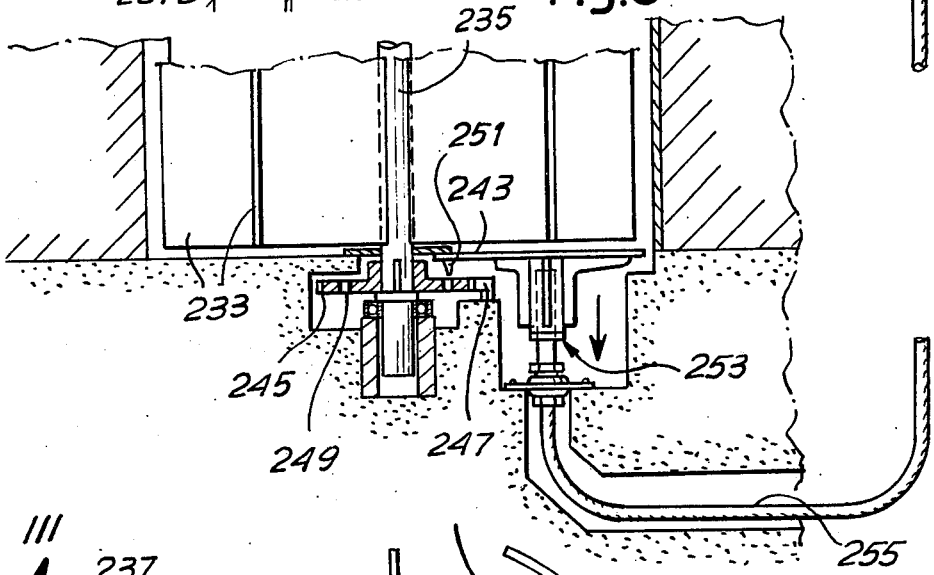
FIG. 2 is an enlarged detailed plan view of the variation of this embodiment.
Figure 2:
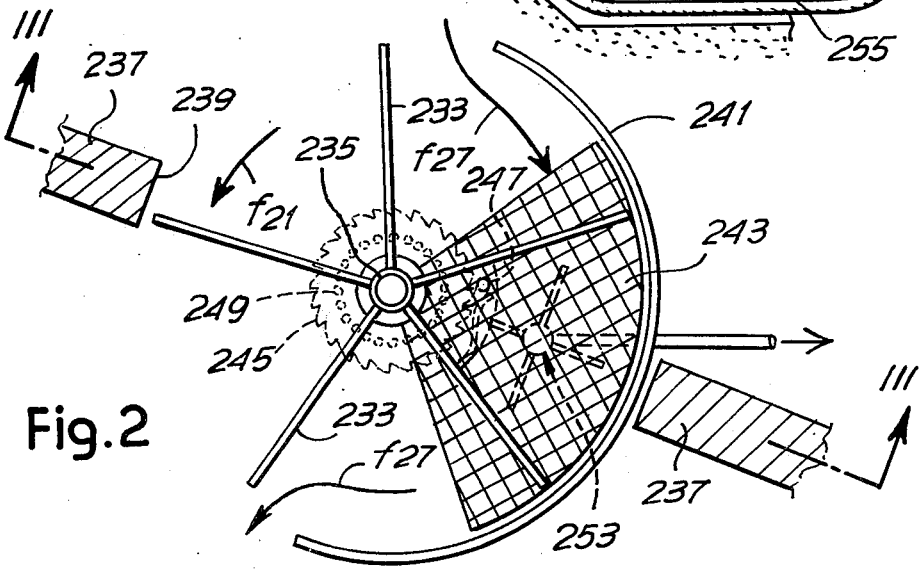

The passage to be controlled, which has been shown in FIG. 1 as a corridor 231A, 231B, may also be made, as shown in FIG. 2, as a wall 237 provided with a recess or opening 239 in which the door, constituted by the radial walls 233, is mounted, the door including the upright central post 235. In this embodiment, in order to allow transit through wall 237 in the direction indicated by arrow $f_{21}$, there is provided a wall 241 in the form of a cylindrical wall sector partially embracing the rotatable door.

Figure 3:
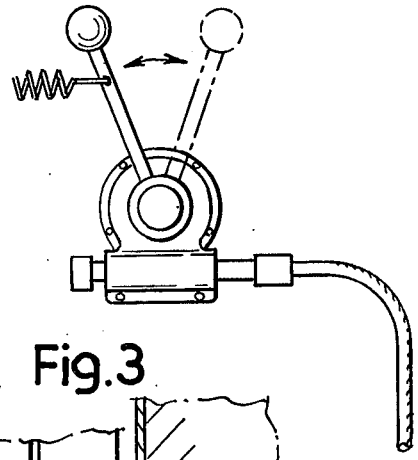
FIG. 3 is a partial vertical sectional view taken along the line III—III of FIG. 2.

The arrangements of FIGS. 1, 2 and 3 involve means for preventing fraudulent transit in the direction opposite to the predetermined direction, that is, in directions opposite to those indicated by arrows $f_{23}$ and $f_{21}$. In particular, a fraudulent transit could occur in the direction of the arrow $f_{25}$ of FIG. 1 or the arrow $f_{27}$ of FIG. 2.

To avoid such fraudulent or undesired transit, in the arrangement shown in FIGS. 2 and 3, there is provided, along the path indicated by the arrow $f_{27}$ a vertically yieldable foot-board 243 indicated in FIG. 2 by grid lines and designed to lock the door 233, 235 when a person is fraudulently passing on the board 243, thus subjecting this board to his weight. As shown in FIGS. 2 and 3, the door 233, 235 has integral therewith, or fixed thereto, a ratchet gear 245 with inclined teeth and which is designed to cooperate with a pawl 247 for preventing rotation of the door in a direction opposite to that indicated by the arrow $f_{21}$. The gear 245 is further formed as a disk having a circle of holes or apertures 249, in anyone of which a pin or plug 251, projected from the lower surface of board 243 may engage. Foot-board 243 is maintained in an upper position, in order to keep the pin 251 out of the apertures 249, for example by resilient means directly reacting on the floor and on the bottom of the housing for the foot-board. The foot-board can be lowered in a guided manner by a guide structure 253 along which the foot-board 243 is vertically displaceable. In correspondence with guide structure 253, there may be provided a flexible shaft control means 255, or a similar system of a mechanical type or the like, to effect, at at distance from the rotatable door, the raising of foot-board 243 even with a load pressing thereon. Without external intervention, one transiting in the direction of the arrows $f_{27}$ would remain imprisoned in a compartment defined by two adjacent walls 233, wall 241 and foot-board 243. A person thus restrained will also remain incapable of being offensive, as he cannot use arms or weapons, if walls 233 are continuous without any opening and formed, for example, of a bullet-proof crystal glass.

In the embodiment of the rotatable doors shown in FIGS. 4, 5 and 6, where elements corresponding to those shown in FIGS. 2 and 3 have been similarly indicated, door 233, 235 is prevented from rotating in a direction opposite to the desired direction, which desired direction as indicated by the arrow $f_{26}$, which allows transit of the direction of arrows $f_{27}$. To assure rotation of the door only in the indicated rotational direction, there are provided two vertically yieldable foot-boards 261, 263 normally maintained at the floor level with, for example, resilient means 265 directly reacting on the bottom surface thereof. On the upper surfaces of these foot-boards and on the floor of the transit area indicated by the arrow $f_{27}$, slippers or shoes 267 act with either a sliding or a rolling action, being resiliently biased downwardly and carried by radial walls 233 of the door in such a manner that they cannot be operated from behind any of these walls, considered with respect to the rotational direction indicated by arrow $f_{26}$. Following each foot-board 261, 263 in the advance direction indicated by arrow $f_{26}$, there is a fixed segment 270, 272 located at the floor level.

In the event that an intruder attempts to rotate the door in a direction contrary to the desired direction by getting between two angularly adjacent panels 233, as the intruder transits on one of the foot-boards 261, 263, the latter will be lowered, as indicated for board 261 in FIG. 6, to effect locking of the rotatable door. Thus, one of the elastic shoes 267, due to the lowering of the board caused by the weight of the intruder thereon, will abut against the fixed segment 270 or 272. Considering the direction of rotation of the door, the slippers, which assure locking of the door against movement, are located on the leading faces of the radially extending panels 233, rather than on the trailing faces thereof considered in the direction of rotation, in such a manner that there is not even the slightest chance of interference with their operation. There may be also more than one slipper 267 on each radial wall 233 of the rotatable door.

In the arrangment of FIGS. 2 and 4, the arcuate wall 241 forms a semi-cylindrical protecting cover defining a cylindrical sector partially embracing the rotating door. Wall 241 is formed of bullet-proof crystal glass, or in a similar manner, and is so arranged as to prevent the intruder from exiting through one of the contiguous panels between which the intruder is located and harming, with weapons, when he is imprisoned or restrained, as mentioned above.

In the embodiment of the invention shown in FIGS. 7 and 8, the rotatable door comprises a vertically oriented rotatable post 331 and radial elements, such as baffles or diaphragms, 333 each secured to post 333 and each including a plurality of vertical spaced horizontal bars. The door is arranged in a passage which is designed for transit in only a single predetermined direction, such as the passages 335, 337, to extend like a labyrinth therein or therebetween. One or preferably two fixed grid walls 339 may be provided to cooperate with the grid walls 333 of the door. With this arrangement, the rotation of door 230 is designed for the direction $f_{30}$, the permitted transit between passages 335 and 337 can take place with rotation of the door, while transit in the opposite direction, as indicated by the arrow $f_{32}$, is not possible due to the presence of the grids 339. On the other hand, the labyrinth passage prevents an intruder who is in area 337 from dominating a room communicating with area 335, the latter being hidden by the presence of the labyrinth.

A rotatable door, as just described, may serve efficiently in the even that the passage is not a rectilinear corridor, but is curved or the like so that persons in the passage remain defiladed with respect to the weapon sighting line of an intruder. In rectilinear passages, the radial grid walls always leave a certain space between adjacent elements, in which space a weapon barrel can be inserted, and thus do not assure absolute safety of personnel. The arrangement of curved walls, as indicated in FIGS. 7 and 8, can compensate for this, and the door 330 especially serves for access to the premises protected with the equipment embodying the invention.

In the case of the radial grid walls of the door shown in FIGS. 7 and 8, it would not be possible to render inoffensive an intruder trying to saturate the passage, in which he has been restrained, with hypnotic gases, while it would be possible to do so, by placing above or under the panels, such as those indicated at 233, rubber bands or strips or the like which assure at least a partial seal and thus the possibility of saturating with gases the recess defined between angularly adjacent radial walls 233.

Figure 9:
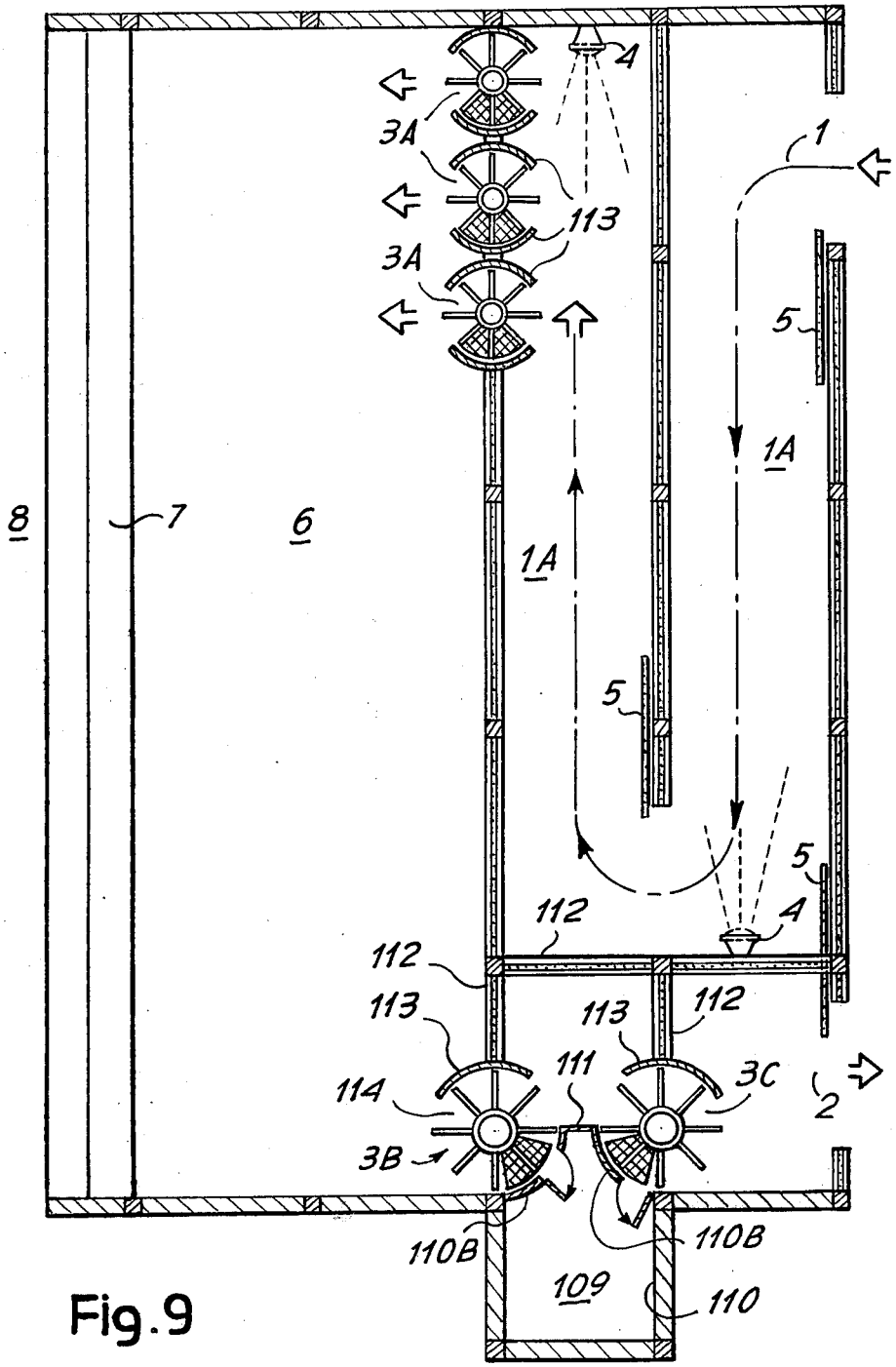
FIGS. 9 through 14 are plan views diagrammatically illustrating various arrangements of the equipment embodying the invention.

FIGS. 9 through 14 illustrate examples of premises with entrances and exits controlled by rotating doors of the above-described types. Thus, FIG. 9 illustrates an entrance 1 leading to an entrance corridor 1A, and an exit 2 leading from an exit corridor. Unidirectional rotating doors 3A, of the types already described, are arranged in parallel for the transit of persons entering the premises, and unidirectional rotating doors 3B and 3C, of the types already described, are arranged in series to control exit from the premises. All the doors, or at least doors 3B and 3C, are doors of the type in which only one person at a time may pass therethrough. The fixed paths have television cameras, such as the television cameras 4, located therealong and are provided with locking doors 5, which may be sliding doors. Reference character 6 indicates the space before the bench or counter 7, and reference character 8 indicates the staff area.

A recess or caveau, called an anti-hostage space, is indicated at 109 as provided within a wall 110 and further defined by the cylindrical sector panels 110B of bullet-proof glass which cooperate with a third panel 111, of bullet-proof glass, which divides the space included between rotating doors 3B and 3C into two portions. Further closures are provided by the panels 112 associated with the wall 110, and other cylindrical sector panels, of bullet-proof glass, are indicated at 113 with the arrangement being such that one of the sector spaces must be stopped in substantial alignment therewith. These sector panels, together with the radial panels 114, define a space in which the security personnel can confine a robber, or a hostage to get the hostage away from the robber.

Figure 10:
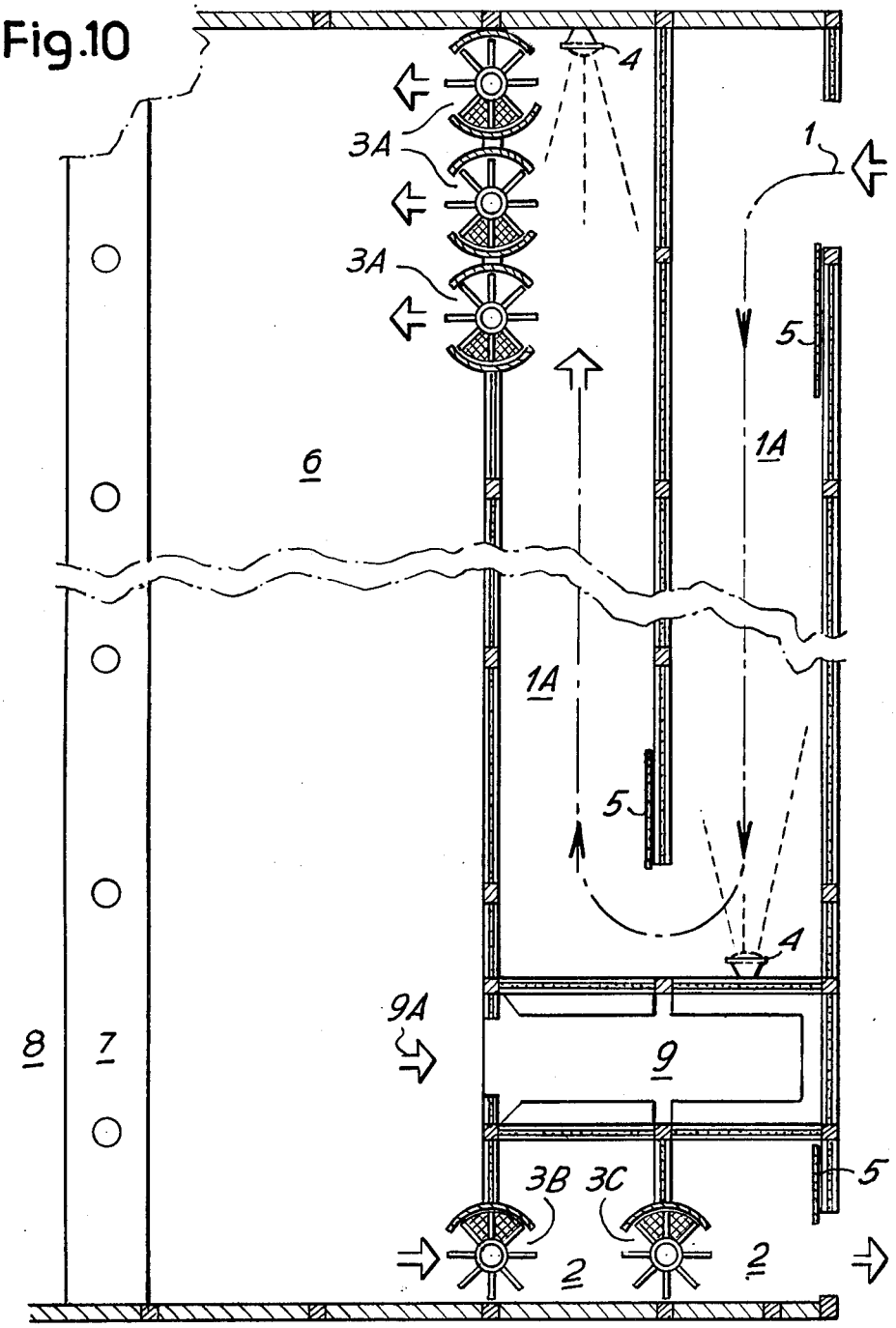

The arrangement of FIG. 10 is essentially similar to that of FIG. 9, but further includes a guard room 9 for the security personnel and which may be provided with an access door 9A with automatic means for locking the door, with operating means, with remote distance transmission, and with signaling means. Guard room 9 may also serve as an anti-hostage recess or caveau, should the rotating doors, which can rotate in only one direction, be arranged in the exit corridor in an appropriate manner adjacent the guard room.

Figure 11:
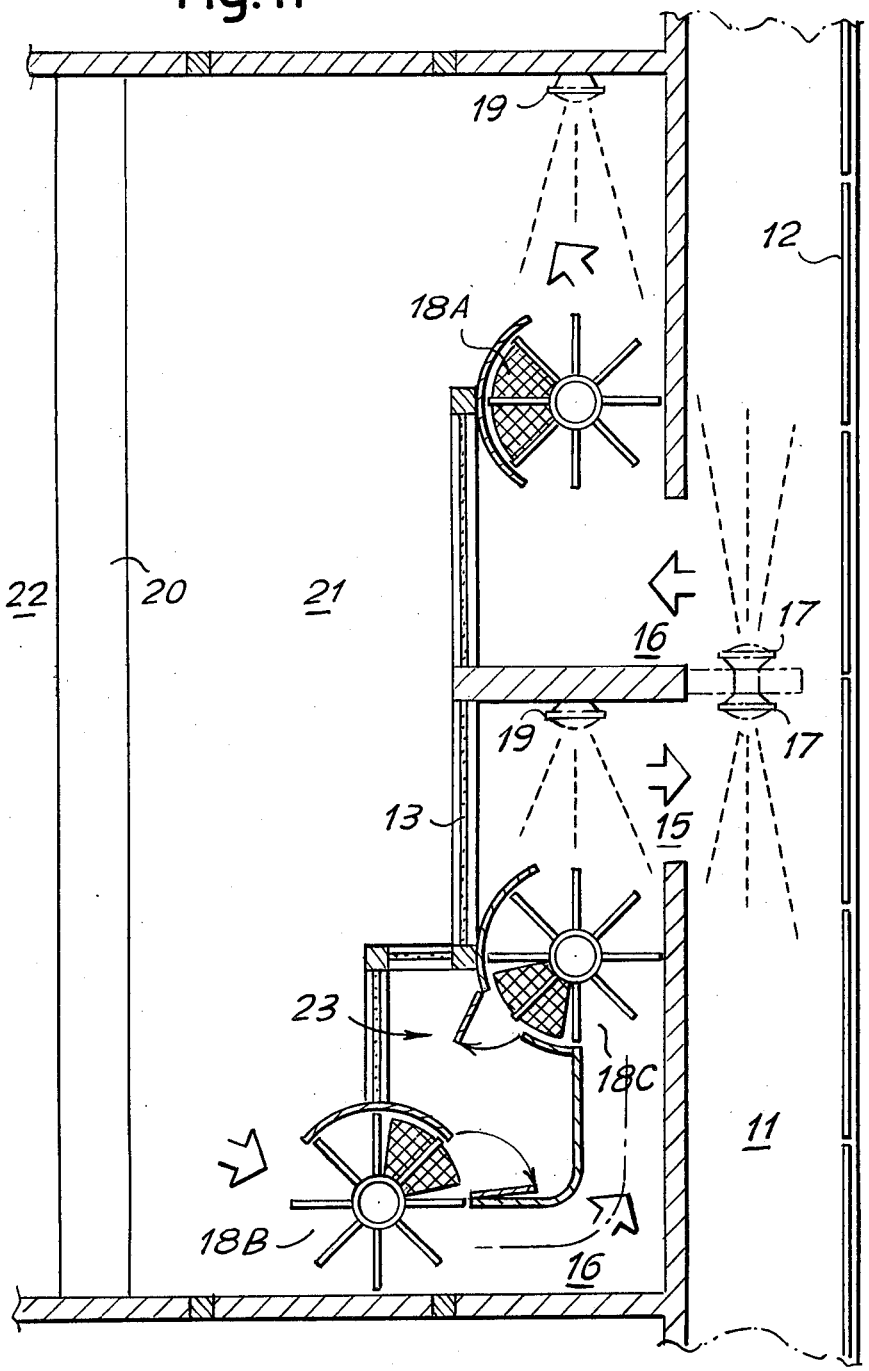

FIG. 11 illustrates an equipment layout utilizing the sidewalk or the like in front of the bank, and the sidewalk is indicated at 11 with 12 indicating a side or bank along the edge of the sidewalk and preventing persons entering the bank without being seen by the external television cameras 17 which are connected with a recording monitor. An internal partition 13 is provided within the premises, which latter have an entrance 14 and an exit 15. Entrance 14 is provided with the unidirectional rotating door, of the type already described, indicated at 18A and exit corridor 16 is provided with two of these doors 18B and 18C arranged in series and which allow only one person to pass at a time. The premises are further provided with internal television cameras, 19 also connected with a recording monitor. A bench or counter 20 divides the public space 21 from the stand space 22, and an anti-hostage recess is provided at 23 between the doors 18B and 18C.

Figure 12:
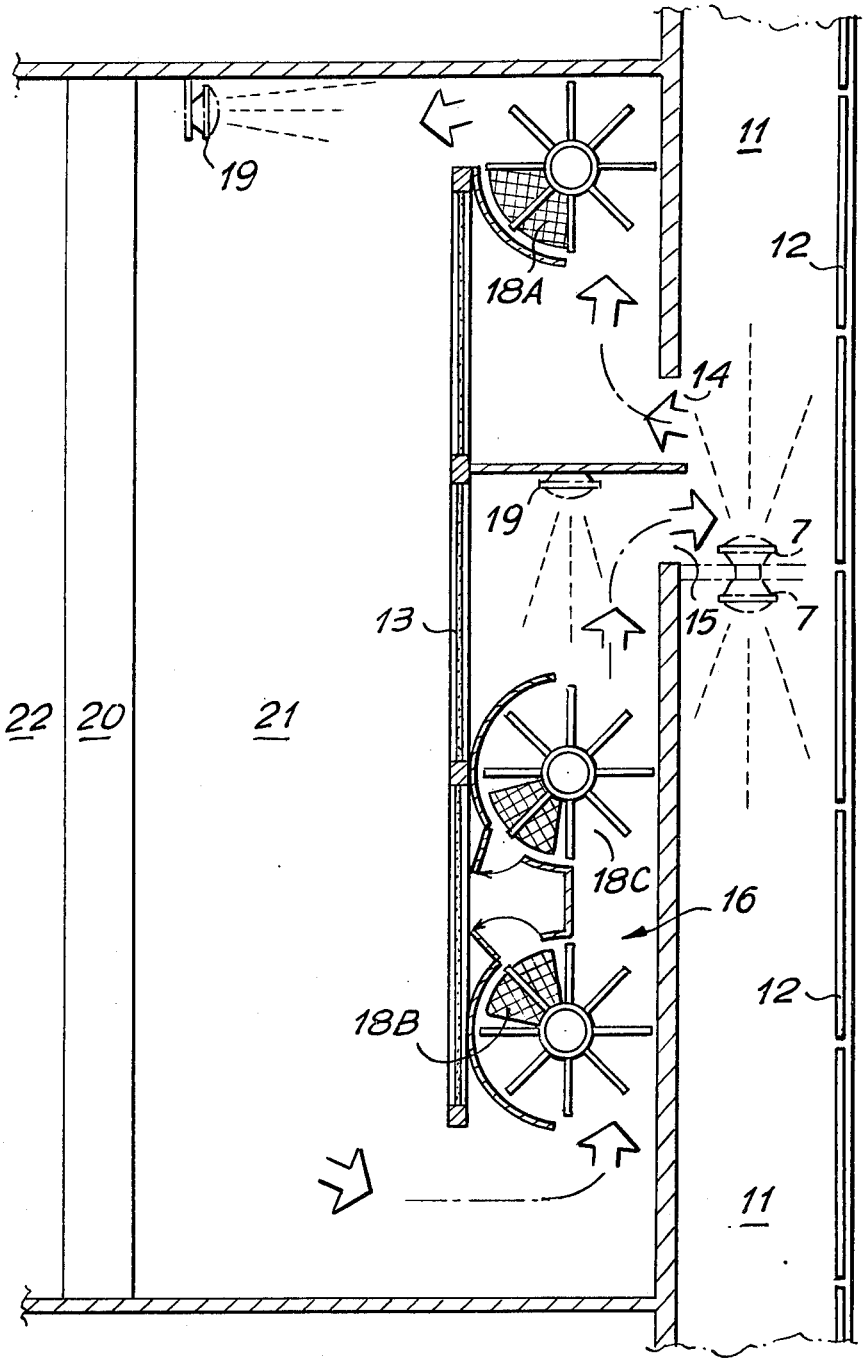
Figure 13:
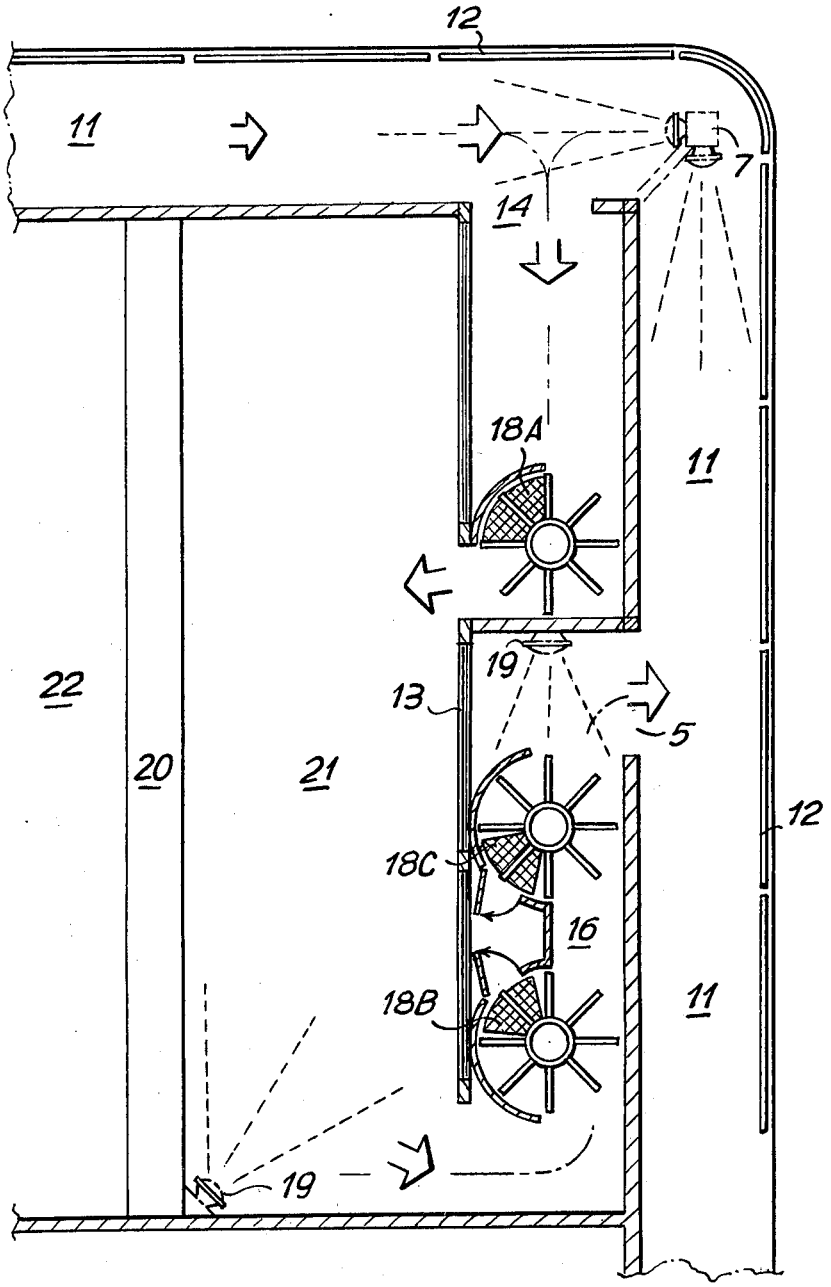

The arrangement shown in FIG. 12 is essentially similar, differing only in slight respects, from that shown in FIG. 11, and corresponding elements have been designated by the same reference numbers as used in FIG. 11. FIG. 13 illustrates a scheme which is similar to that of FIGS. 11 and 12, the only variation being that the layout shown in FIG. 13 is suited for premises or a room which is located at a street corner, as indicated.

Figure 14:
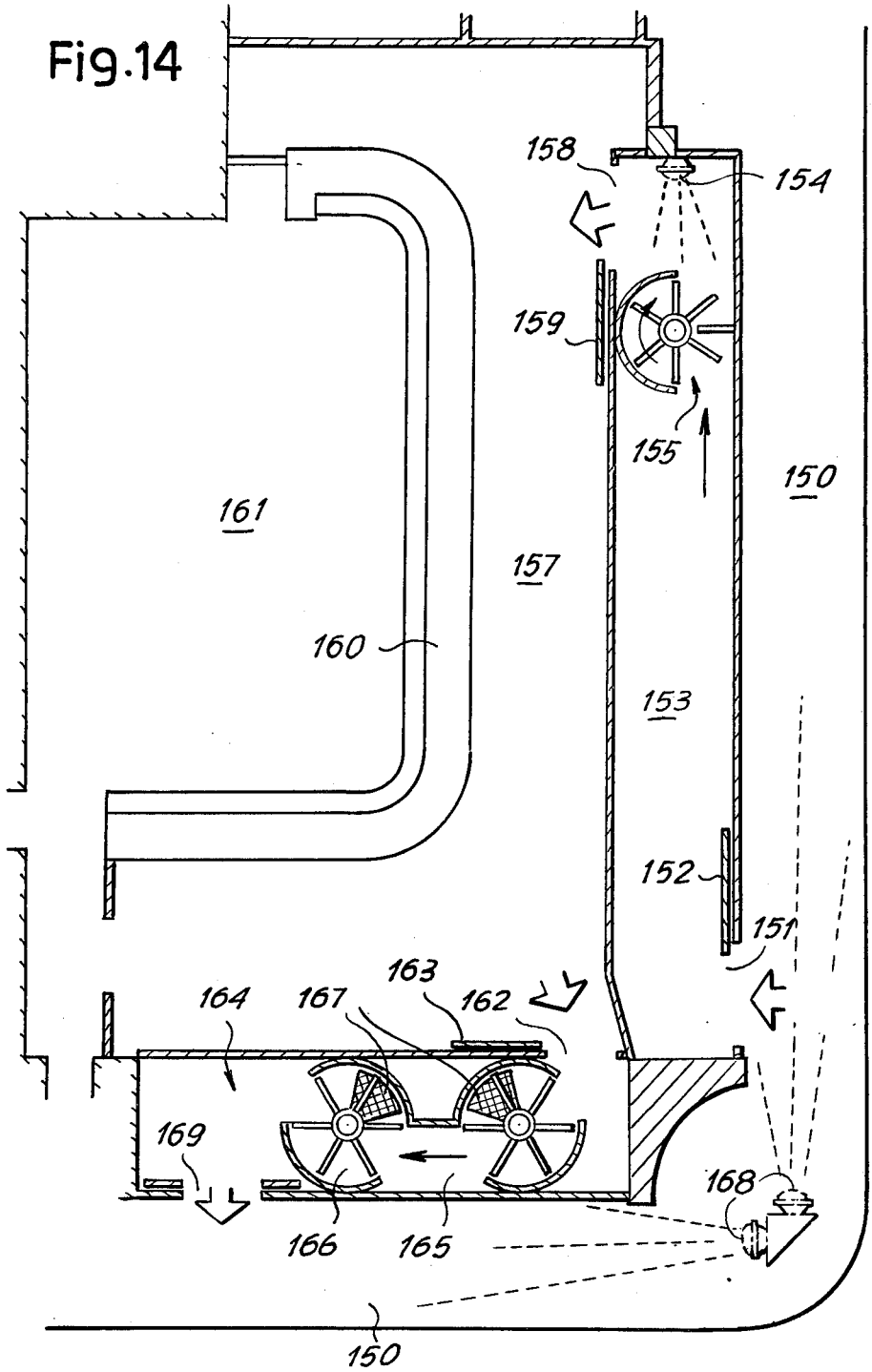
Figure 15:
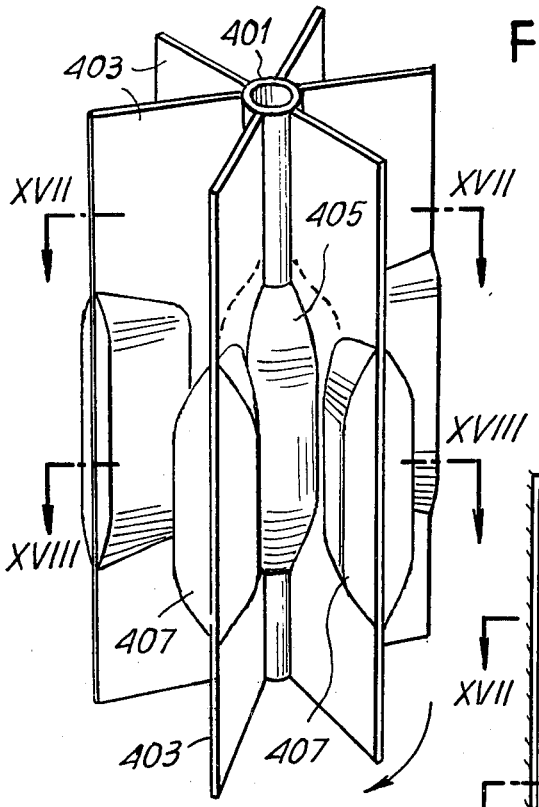
FIG. 15 is a perspective view of a specific embodiment of the rotating door allowing transit of one person at a time.
Figure 16:
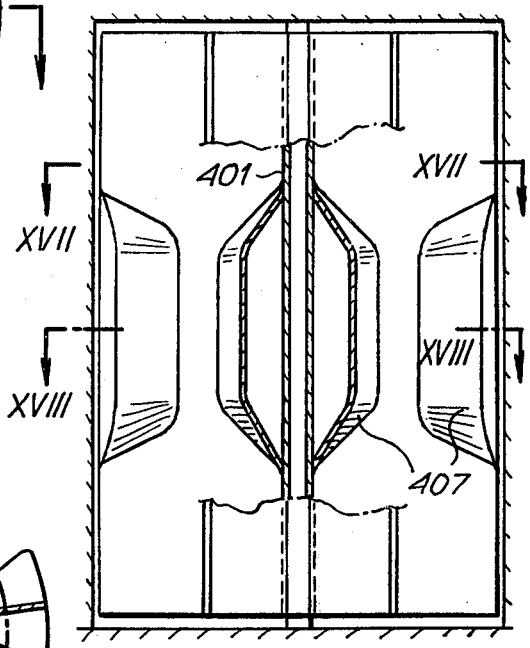
FIG. 16 is an elevation view, partly in section, of the door shown in FIG. 16.
Figure 17:
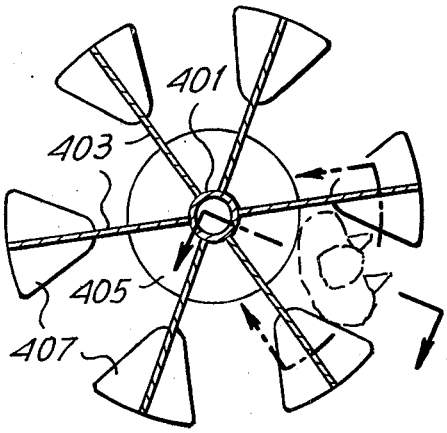
FIGS. 17 and 18 are horizontal sectional views taken along the lines XVII—XVII and XVIII—XVIII of FIGS. 15 and 16.
Figure 18:
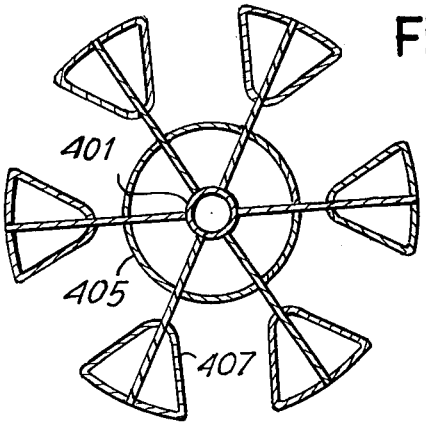
Figure 19:
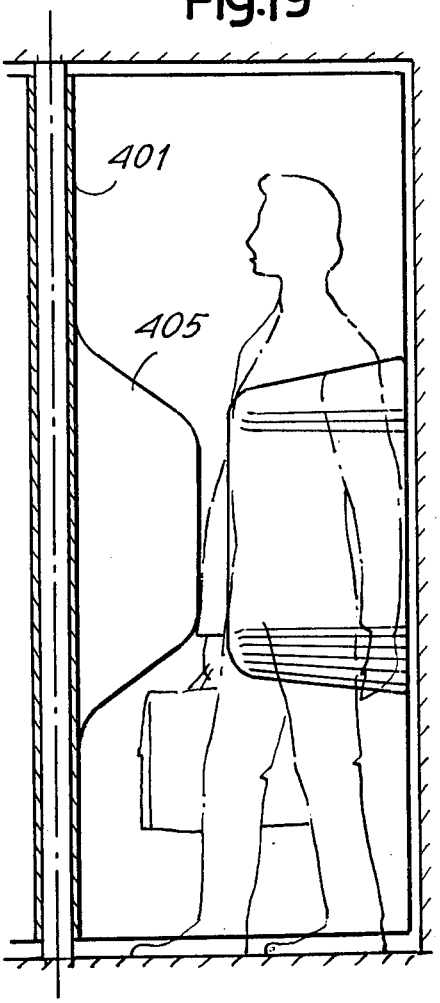
FIGS. 19 and 20 are sectional views illustrating the manner in which a person is accommodated in one of the areas defined in the rotating door of FIGS. 15 and 16.
Figure 20:
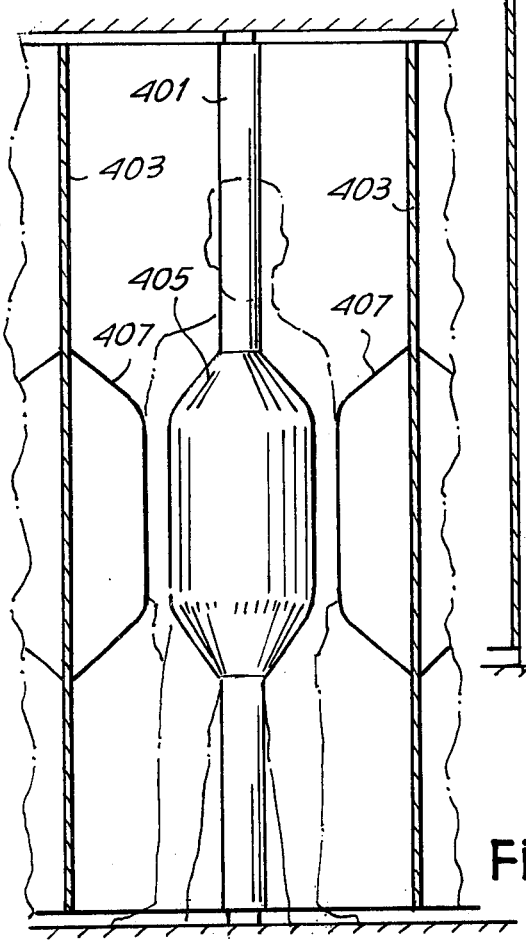

The layout of FIG. 14 is also provided for premises or the like located at a street corner formed by the intersection of two sidewalks 150. The entrance 151, which may also be locked by a slidable door 152 which is pneumatically controlled, leads to a laterally confined entrance corridor 153 viewed by a group of television cameras 154 which may be combined with the temporary image recorder. At the inner end of entrance corridor 153, there is a unidirectional rotating door 155 of the type described with respect to FIGS. 7 and 8. A person can reach the public space 157 from corridor 153 through a passage 158 controlled by a sliding door 159 which may be, for example, pneumatically operated. A bench or counter 160 separates the public space 157 from the staff space 168, and bench 160 may be provided with safety devices preventing jumping of the bench and also with bullet-proof defense walls. From public space 157, a passage 162, controlled by a sliding door 163, leads to a laterally confined exit passage 164 in which two unidirectional rotating doors 165 and 166 are arranged in series, these doors being of the type previously described providing for transit of one person at a time. The doors are associated with locking foot-boards 167 and with radials panels and a center post, a previously described. Two television cameras 168, similar to the television cameras 154, may be arranged to control or oversee transit on the pavement 150. The exit to pavement 150, from corridor or passage 164, is indicated at 169, and this exit may be provided with a locking door having a pneumatic remote control.

In FIGS. 9 through 14, the locking foot-boards, which are similar, for example, to those denoted by 243, 261, or 263, are indicated in dotted outline and extend in correspondence to arcuate panels such as the previously-described arcuate panels 241.

FIGS. 15 through 20 illustrate an embodiment of the rotating door, in accordance with the invention, capable of rotating in only one predetermined direction and insuring transit of a single person at a time through each of the spaces defined by radial panels, while allowing compliance with the safety and comfort requirements for the users. Referring to these figures, a central column 401 defines the vertical rotational axis of the rotating door, and column 401 is combined with means to allow only angular movement of the door in a single direction and means to effect locking of the door, such as already described. The door includes radial diaphragms 403 which may be made of crystall glass but, in any event, are bullet-proof. The space included between two angularly adjacent diaphragms 403 is substantially dihedral, and this space is reduced to assure that it remains sufficient for only one person in transit therethrough as best seen.

For this purpose, in correspondence with the intermediate portion of the person's height and starting from column 401 and extending between angularly adjacent diaphragms 403, there is formed a vertically elongated shaped projection 405 which limits the space toward the column or post 401. Additionally, on each surface of each of the radial diaphragms or walls 403, there is formed, always in correspondence with the intermediate portion of a person's height, a vertically elongated abutting projection 407 increasing in the extent of its projection in accordance with the increase in the radial distance from the axis of column or post 401. Projections 405 and 407 reduce the space available for a person transiting through the door to the point of preventing the presence of a second person in the same space. However, the person who is in this space has no sensation of being in an excessively small space as, in the upper portion of the bust and adjacent the head, the space is maximum defined by the two diaphragms 403 and is not reduced by the projections 405 and 407. Moreover, the person's legs remain free for motion within the total space of the lower portion between contiguous walls 403. The projections 405, 407 may be made, for example, of a transparent synthetic material, of appropriately sturdy quality and thickness and appropriately applied in a substantially firm manner on the walls 403 and the post 401.

When the rotating doors are made in such a manner whereby only a single person may pass therethrough at a time, their performance also serves, in a specific manner, as anti-hostage doors. In such a case, the rotating door is provided with a locking device, for example of the mentioned type or of the type having two-shoes brake operated pneumatically or in similar manner, so that a robber may be stopped as he transits in a sector of the rotating door, when he attempts to get out of the bank, and thus also in the eventuality he is preceded by a hostage.

A pneumatic locking apparatus which may be used for this purpose is described, for example, in French Pat. No. 1,253,130 and in the corresponding U.S. Pat. No. 3,045,775, with appropriate arrangements to the particular case of the actuation of door locking, the doors being rotatable by the cylinder-piston system. A pneumatic system of this type operates by a decrease in pressure and thus also if impaired either by the robber or by the staff of the bank under the physicological stress of a criminal action.

In order to emphasize at its utmost that dissuasive power or action of the equipment from effecting a robbery, right from the moment this is projected, it is necessary that intruders be convinced of the absolute impossibility of impairing or of preventing the operation of the locking device for the rotatable door, or of the device being impaired by the staff under armed threats. For this purpose, the locking device operates with pneumatic power and is arranged in such a manner that its braking action is developed responsive to a decrease in pressure in tubular connection elements between a compressed air tank and the pneumatic brake. With the arrangement operating responsive to a decrease in pressure, it results that the only rapid way which could be used, and would be advantageously used if the brake were mechanically or electrically operated, that is the interruption of the connections between the pushbutton or pedal and the power delivery device, leads to the fact that, on the contrary, for the consequent decrease in pressure, the locking device is activated.

It is obvious that the operation of the locking device for the rotating door necessitates that there is always security personnel on watch to activate the equipment, should this be made necessary. For this, and in a particular manner in small banks, where usually there are few employees, if they are directly in charge of the watching, it will be advantageous to arrange, on the bench, means preventing jumping over the bench to avoid, as has already happened quite often, that robbers jump over the bench and shut the staff in a service room of the bank.

Should it be desired to have a plurality of dissuasion means, the apparatus can be provided with a device capable of saturating the corridor, including the second rotating door and the room exit door, with gas, particularly a gas which is not harmful for personnel in the rooms, but will be such as to produce a momentary fainting so as to prevent inconsiderate reactions, should one or more robbers be near the exit door. The specific anti-hostage performance is always assured also in the case in which the robbery is effected by several persons. In this case, it is necessary that the exit corridor be provided, as in the illustrated layouts, with at least two series arranged unidirectional rotating doors, of the type providing for transit of only one person at a time, such as the doors 3B, 3C, or 18B, 18C.

If it is supposed that two robbers have entered the bank, have finished the robbery and are planning to go out, with the possibility of taking a hostage with them, one of the robbers will transit through the first rotating door while the second robber, who is still in the space in front of the bench and carrying the menacing weapon, will order the hostage to follow his companion and thus transit, in his turn, through the door. At this stage, in the sector of the exit corridor included between the two unidirectional doors, the two robbers and the hostage are present. The problem then arises of who will pass first through the second rotating door. Obviously, it will not be the hostage. Thus, one of the robbers will pass through the second rotating door and the hostage and the other robber will remain between the two unidirectional rotating doors. At this point, if the robber passed first through the door, he would be locked, be means of the mentioned devices, in the second rotating door or between the second rotating door and the exit door by the watching personnel. In such a case, if the hostage passed first, he would be locked in the roating door and thus protected from the robbers.

It must be remembered, however, that the hostage may get away from the robbers, also in the case where the watching personnel does not intervene should he, at the moment when he transits through one of the unidirectional doors, go into the sector which assures the unidirectionality of the path as, in this case, the rotating door will be automatically locked, thus putting the hostage in a safe position from any possible reaction by the robbers, as the radial panels are provided with bullet-proof glass. From this place, the hostage will be able to pass into the anti-hostage recess 109 through a sliding door appropriately arranged in the fixed cylindrical wall located on the outer edge of the periphery of the rotating door. Consequently, the calibrated foot-board, being no longer loaded by the weight of the hostage, will be automatically relocated in the pre-operational position, resetting the usual operation of the door. The foot-board or the like may act, being lowered upon operation of a control valve of a pneumatic equipment such as that shown in the above-mentioned patents. It is also obvious that the hostage may lock the sliding door from the interior of the safety recess, to prevent an eventual attempt at intrusion of the robbers.

Also, in the more complicated case of two or more hostages in the hands of the robbers, at least the last of the robbers, who will leave the bank, may be locked between the radial walls of the rotating doors. Even if one or more robbers tries to protect the flight of his colleague, who passes through the doors last, and thus halts with one or more hostages between the second rotating door and the exit door, they will naturally think that a single instant of halt may be fatal for them, as that particular recess in the corridor may be saturated in a very short time with soporific gas or the like. It will be clear that all of this emphasizes to the maximum the dissuasive power performed by the described anti-robbery equipment.

All of the above-stated possibilities hold should also the unidirectional door or doors of the entrance corridors be applied with the locking device, in the case that the robbers intend or plan to obtain a hostage upon entry of the bank, that is, in the entry stage instead of the exit stage.

While specific embodiments of the invention have been shown and described in detail to illustrate the application of the principles of the invention, it will be understood that the invention may be embodied otherwise without departing from such principles.

What is claimed is:

1. Anti-robbery and anti-hostage equipment, for the premises of banks and the like, comprising, in combination, means forming at least one laterally confined passage, having a ceiling and a floor, communicating with the premises to be protected; at least one rotating door, including a vertically oriented rotatable post and a plurality of angularly spaced elements secured to and extending radially from said post, in each passage freely rotatable in a single direction to permit one person at a time to pass along said passage in said single direction; and means operable, responsive to a person entering into said door and attempting to rotate said door, to pass along the passage in a direction opposite to said single direction, to lock said door against rotation; said angular spaced radial elements comprising radially extending imperforate walls, having a height substantially equal to the height of said at least one laterally confined passage; said column and said radially extending walls having vertically elongated bulge portions projecting into the sector spaces defined between adjacent angularly spaced radially extending walls; said bulges being positioned on both surfaces of each radially extending wall; said bulges extending vertically only intermediate the height of a person to provide full clearances, in the sector spaces above and below said bulges, to provide full clearance for the head and feet of such person; whereby only one person at a time can occupy a sector space.

2. Equipment as claimed in claim 1, in which said person-responsive operable means includes at least one foot-board resiliently yielding under the weight of a person attempting to transit through said door in a direction opposite to said single direction, and effecting locking of said rotating door.

3. Equipment as claimed in claim 2, including a locking member on said foot-board; and a restraining member rotatable with said rotating board; said locking member interengaging with said restraining member when said foot-board is lowered due to the weight of a transiting person.

4. Equipment as claimed in claim 2, in which said means operable to lock said door against rotation comprises shoe means on said angularly spaced elements of said rotating doors; means biasing said shoe means downwardly to engage and ride along the floor and each foot-board; and fixed radial stop means arranged, with respect to each foot-board, downstream in the rotational directional of said rotating door; said shoe means, when lowered responsive to lowering of each foot-board, engaging said radial stop means.

5. Equipment as claimed in claim 1, in which said angularly spaced elements comprise radially extending walls of bullet-proof glass.

6. Equipment as claimed in claim 1, including fixed cylindrical walls extending partly around the periphery of each rotating door to defilade the associated passage with respect to firing of weapon available to a person locked by said equipment.

7. Equipment as claimed in claim 1, including labyrinth means between the sections of each passage on opposite sides of each rotating door to defilade the passage with respect to firing of a weapon available to a person locked by said equipment.

8. Equipment as claimed in claim 2, including a wall of fixed panels at least partly surrounding each rotating door to define a partial wall extending around the associated rotating door at least along the outer peripheral edge of each foot-board.

9. Equipment as claimed in claim 1, including, in at least one said passage, at least two rotating doors operating in parallel for the passage of persons.

10. Equipment as claimed in claim 1, including two said rotating doors arranged in series each having at least one foot-board depressible by the weight of a person to lock the door against movement; each rotating door having, along the outer periphery of the associated foot-boards, panels in the form of cylindrical wall sectors connected with each other and defining a recess into which a hostage may pass through a door located in correspondence with the space occupied by a person standing on one of said foot-boards.

* * * * *